United States Patent [19]

Russell, Jr.

[11] 3,973,468

[45] Aug. 10, 1976

[54] MULTI-STAGE EXTENDIBLE AND CONTRACTIBLE SHAFT WITH SHOCK ABSORPTION

[76] Inventor: Wayne B. Russell, Jr., 3895 Lugo Ave., Lynwood, Calif. 90262

[22] Filed: Aug. 2, 1974

[21] Appl. No.: 494,196

Related U.S. Application Data

[63] Continuation-in-part of Ser. No. 418,073, Nov. 21, 1973, Pat. No. 3,957,125, which is a continuation of Ser. No. 177,592, Sept. 3, 1971, abandoned.

[52] U.S. Cl. ..... 91/25; 91/408; 92/2; 92/52; 92/53; 92/85 B; 92/111; 92/113; 92/152

[51] Int. Cl.[2] ..... F15B 15/22; F01B 11/02

[58] Field of Search ..... 92/51, 52, 53, 111, 92/113, 143, 152, 85 B, 2; 91/396, 405, 25, 408

[56] References Cited

UNITED STATES PATENTS

| | | | |
|---|---|---|---|
| 1,548,182 | 8/1925 | Burgin | 92/85 B X |
| 3,136,221 | 6/1964 | Walker | 92/53 X |
| 3,138,066 | 6/1964 | Walker | 91/25 |
| 3,264,952 | 8/1966 | Winders | 92/143 |
| 3,267,815 | 8/1966 | Ortman et al. | 91/396 X |
| 3,483,798 | 12/1969 | Parrett | 92/52 X |
| 3,559,535 | 2/1971 | Connolly | 91/396 |
| 3,610,100 | 10/1971 | Hoffman | 92/108 X |
| 3,768,578 | 10/1973 | Russell, Jr. | 92/53 X |
| 3,838,625 | 10/1974 | Bell | 92/85 X |

FOREIGN PATENTS OR APPLICATIONS

| | | | |
|---|---|---|---|
| 234,167 | 12/1968 | U.S.S.R. | 91/67 |

*Primary Examiner*—Martin P. Schwadron
*Assistant Examiner*—Abraham Hershkovitz
*Attorney, Agent, or Firm*—D. Gordon Angus; Donald D. Mon

[57] ABSTRACT

An extendible and contractible shaft comprises a number of shaft members on a common longitudinal axis, each except the outermost member being telescoped within the one next adjacent. Each telescoped member has a piston slidably sealed to the inner wall of the next adjacent outer member to form a series of tandem arranged sealed pistons. Fluid passageways are provided between adjacent shaft members so that fluid supplied under pressure to an inlet port of the device flows through the passageways to all the piston heads, thereby extending the telescoped shaft members and at the same time driving fluid out from under each piston through fluid passageways to an exit port of the device. When the pressurized fluid flow is reversed to send pressurized fluid to the undersides of the pistons, thereby driving fluid above the piston heads out through the first mentioned port, there would normally be incurred substantial shock as each piston head strikes its stop in the retraction operation. The shock is prevented by provision of an annular rim at one or more of the piston heads with surfaces which gradually meet a corresponding surface of the next outer shaft member, thus progressively restricting the outward flow of fluid from above the piston heads and slowing down the retraction sufficiently to prevent shock. In another aspect a surface of the piston gradually meets a port exiting from above this piston to meter and slow down the outward fluid flow.

8 Claims, 5 Drawing Figures

MULTI-STAGE EXTENDIBLE AND CONTRACTIBLE SHAFT WITH SHOCK ABSORPTION

This is a continuation-in-part of application Ser. No. 418,073, filed Nov. 21, 1973 now Pat. No. 3,957,125 as a continuation of application Ser. No. 177,592, filed Sept. 3, 1971 now abandoned.

This invention relates to extendible and retractible shafts or booms or jacks or the like, and more particularly to such equipment capable of being extended linearly from a relatively short length to a substantially greater length and being contracted or retracted to its minimum length. The boom or shaft equipment is suited to being driven in rotation for such purposes as, for example, the torquing of an earth auger.

In my said co-pending application Ser. No. 318,073 there is shown and claimed a shaft or boom arrangement especially adapted for providing rotational torque for earth drilling purposes. The shaft or boom comprises a number of telescoped members within an outer member, each telescoped member having a piston slidably sealed to the inner wall of the next adjacent outer member to form a series of tandem arranged sealed pistons. Fluid passageways are provided adjacent shaft members and a pair of fluid ports are provided so that pressurized fluid may be sent into one of the ports and caused to flow through the system so that the pressurized fluid is applied to all the pistons in the direction which telescopically extends each shaft member relative to the next outer shaft member in the direction which extends the length of the shaft. When the direction of fluid pressure is reversed so that the pressurized fluid flow into the other of the pots, the pressurized fluid applied to the underside of each of the pistons so that each shaft member is within another member slides in the direction which contracts the overall length of the shaft toward its minimum length.

In Soderstom U.S. Pat. No. 2,705,083 issued Mar. 29, 1955 there is also shown an extendible and contractible telescoped shaft arrangement, which however is not adapted for rotational torque.

It has been found that in the operation of previously known extendible and retractible telescoping shaft arrangements such as those mentioned above, there is experienced undesirably great shock at the end of the limit retraction of each shaft member due to the fact that the piston head of each shaft strikes a stop force of the immediately outer shaft member with substantial speed and force.

An object of the present invention is to provide means for eliminating or substantially reducing the shock of retraction of one shaft member within another.

The invention is carried out by use of fluid metering means positioned to progressively restrict a path of fluid flow from the region of the piston of a shaft member toward the port from which the fluid is exiting from the device during retraction. This metering at the retraction end of a stroke or movement slows down the movement so that shock is prevented or substantially reduced.

In one embodiment the fluid metering means comprises a surface at a piston head related to a surface attached to the next outer shaft member, which gradually decreases as the piston head approaches the end of its permissible travel during retraction.

In another aspect metering is provided by a surface which moves gradually closer to a port from which fluid is exiting from above the piston head during the retraction.

Devices having shock preventing or absorbing features according to this invention are applicable for use either with equipment adapted for being torqued such as for earth drilling or for extension and retraction in the absence of torque.

The foregoing and other features and aspects of the invention will be better understood from the following detailed description and the accompanying drawings of which:

FIG. 2 is a cross-section view taken at line 3—3 of FIG. 1;

Figure 1:
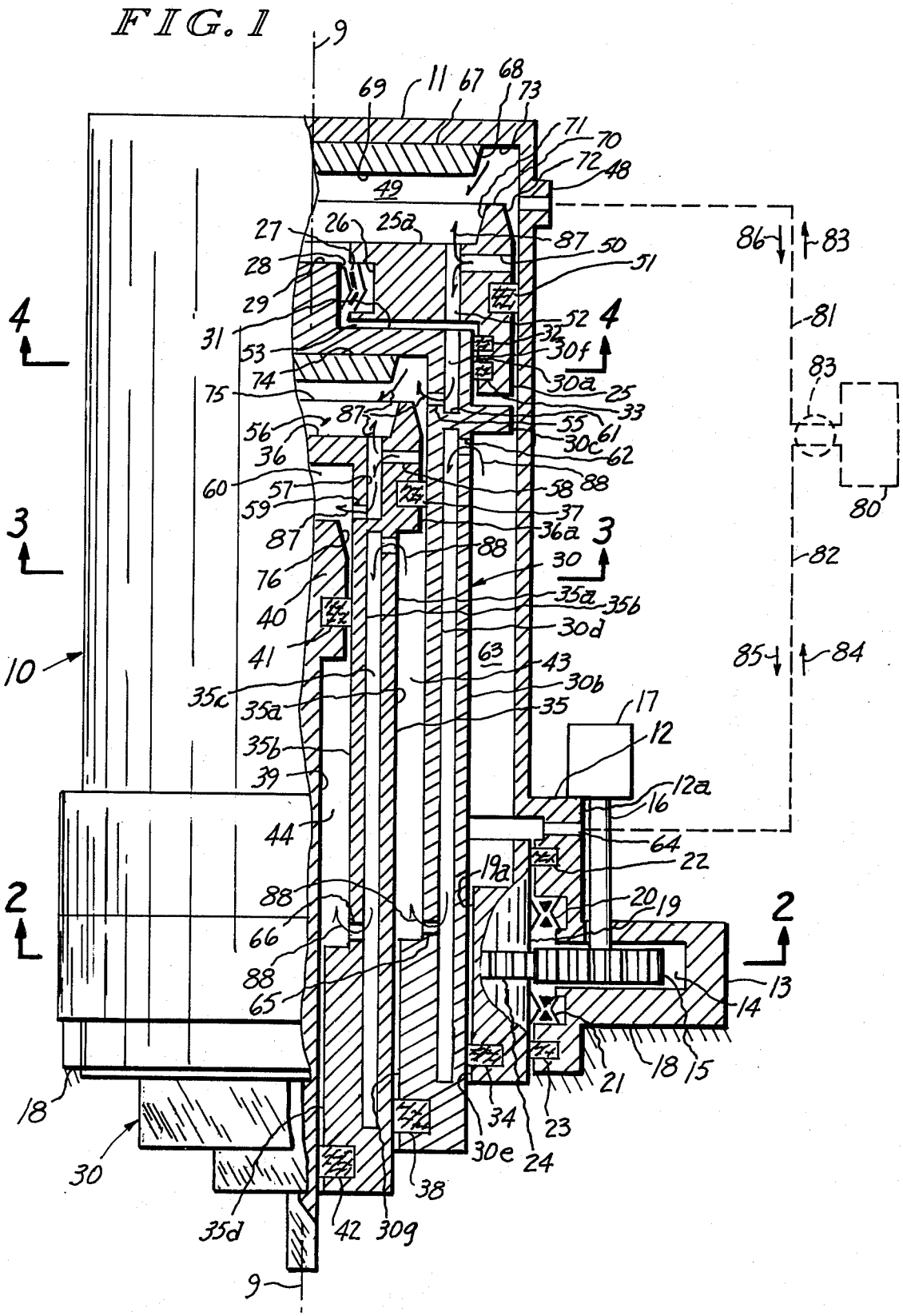
FIG. 1 is an elevation view, partly in cross-section, of a multi-stage extendible and retractible boom device according to this invention.
Figure 2:
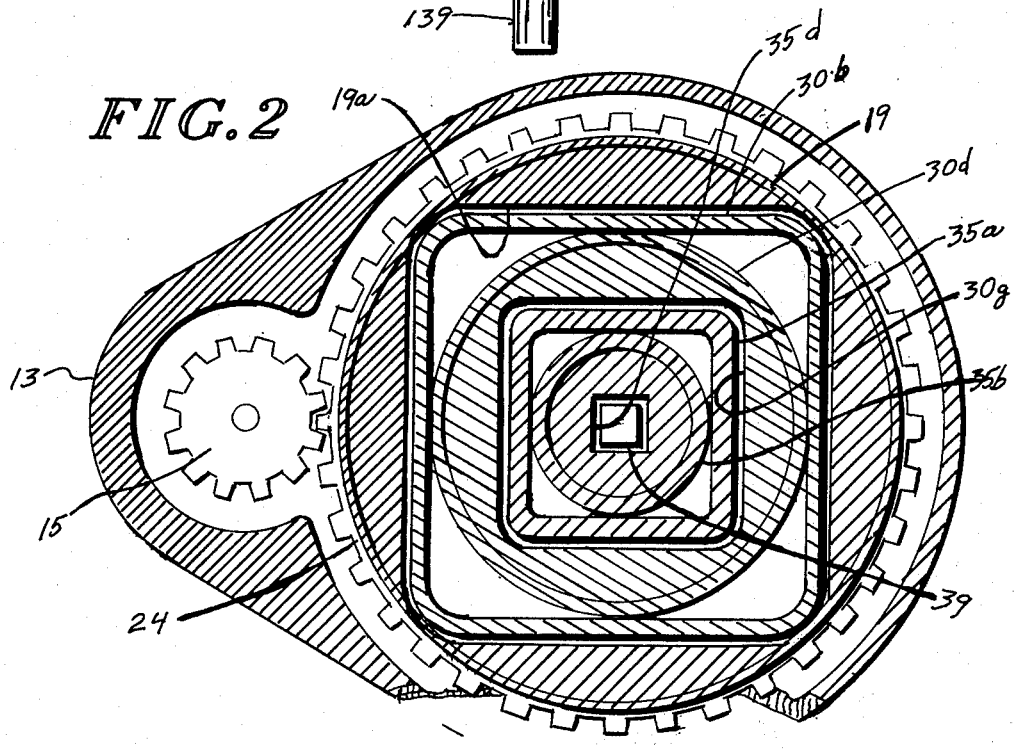
FIG. 2 is a cross-section view, partly broken away, taken at line 2—2 of FIG. 1.

Referring to FIGS. 1 through 4, there is shown a multi-stage extendible and retractible shaft or boom arrangement adapted to be driven in rotation, for example as a Kelly drive for earth drilling. Since it is particularly adapted for use as a Kelly drive it is shown extendible in a downward direction. The device comprises a stationary outer cylindrical shaft member 10 concentric with a longitudinal axis 9 and provided with a closure or head 11 at the top. At the lower part of member 10 its structure is brought outward at position 12 to form an outwardly extending gear housing 13 having an internal cavity 14 containing a pinion 15 fastened to a vertical shaft 16 extending upwardly through the upper wall of housing 13 and attached to the shaft of a motor 17 mounted on the upper surface of gear housing 13, which drives the pinion. The member 10 and the gear housing will be held stationary by mounting on a suitable bed or frame represented at 18, for example the platform of a drilling rig. Within the section 12a outstanding from the tubular member 10 and within the gear housing there is a member 19 having an outer cylindrical member 10 and the gear housing, by provision of bearings 20 and 21 positioned between the gear housing and cylinder 19. These bearings are of a conical type adapted to withstand radial forces and also longitudinal thrust. There is attached to the outer cylindrical surface of member 19 a gear 24 which meshes with pinion 15 so that rotation of the motor 17 rotates member 19 relative to tubular member 10. Seals 22 and 23 serve to prevent the escape of oil from the cavity 14 of the gear housing, which is ordinarily present to lubricate the gears and bearings. A large extent of the inner surface of member 19 is formed in the shape of a square **19*a*, as best seen in FIGS. 1 and 2**.

Figure 4:
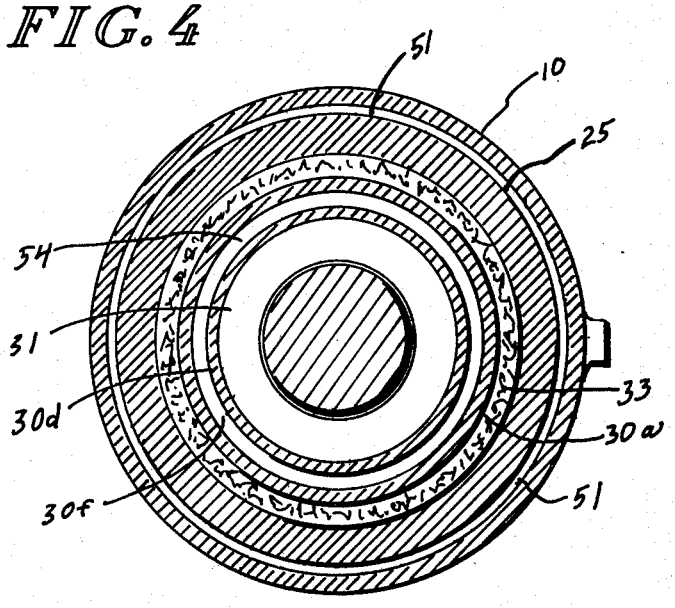
FIG. 4 is a cross-section view taken at line 4—4 of FIG. 1.
Figure 3:
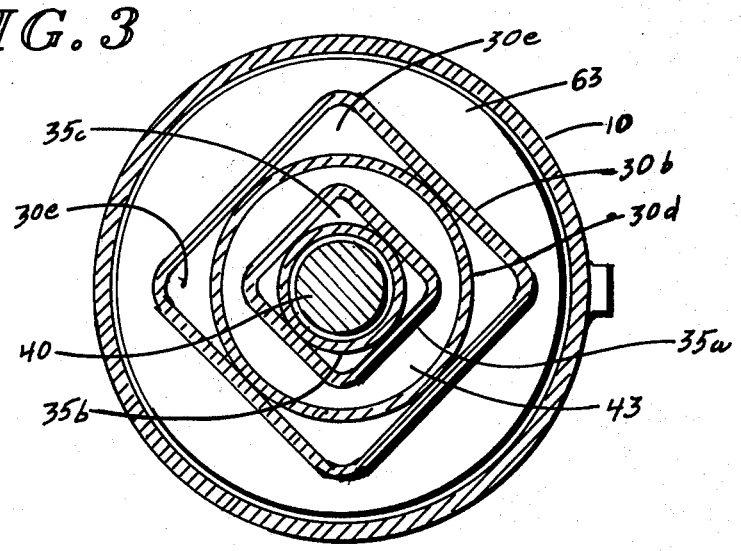

A cylindrical piston 25 is placed concentrically within cylindrical member 10 near the upper end of member 10 and is free to slide longitudinal through an annular seal 51 relative to member 10. Piston 25 has an inwardly extending portion **25*a* and is provided with an internal cylindrical recess 26 in which is set a conical bearing 27 held between the recess 26 and a concentric cylindrical surface 28 of an end section 29 protruding upwardly from an upper portion 30a of a wall of a double-walled shaft member 30 with which member 29 is integral through a horizontal closure or head portion 31. The upper portion 30*a* is cylindrical and concentric with axis 9, as is best seen in FIG. 4. Member 30 is not slidable longitudinally relative to piston 25, but is rotatable relative to piston 25 on bearing 27 and at annular seals 32 and 33 set in circumferential recesses of piston 25. Shaft member 30 is slidable longitudinally relative to member 19 at seal 34 in a recess of member 19. All these seals are in sealing contact with the exterior surface of the outer wall of member 30. At the lower end of portion 30*a* there is an annular flange 30*c* whose periphery is close to the cylindrical inner wall of member 10. Below this flange the outer wall of member 30 has a square cross-section 30*b*, as best illustrated in FIGS. 2 and 3, the dimensions of section 30*b* matching those of portion 19*a* so that member 19 can drive member 30 in rotation. Within the outer wall port 30*b* of square cross-section there is an inner cylindrical wall 30*d* whose periphery below flange 30*c* is tangent, and attached, to the sides of wall portion 30*b*, leaving four columnar spaces 30*e* inside the respective four corners of wall 30*b*. Above the flange 30*c* there is an annular space 30*f* between cylindrical walls 30*a* and 30*d*, the wall 30*a* being cylindrical above the flange. At its lower end wall 30*d* is built inwardly to a square cross-section at 30*g*, as best seen in FIG. 2**.

Within member 30 there is another double walled shaft member 35, slidable longitudinally relative to member 30, and closed at its upper end by a closure 36 which is at the head of a piston 36a integral with shaft member 35, with circumferential seals 37 and 38 set in recesses at the outer periphery of the piston **36*a* and in sealing engagement with the inner wall of member 30. The square cross-section of member 35*a* has dimensions which match those of portion 30*g* so that member 30 can drive member 35 in rotation. The inner wall 35*b* of shaft member 35 has a circular cross-section and its cylindrical outer periphery, concentric with axis 9, is tangent, and attached, to the sides of outer wall 35*a*, leaving four columnar spaces 35*c* inside the respective four corners of wall 35*a*. At its lower end wall 35*b* is built inwardly to a square cross-section at 35*d* as seen in FIGS. 1 and 2. Between walls 30*d* and 35*a* there is a space 43 extending from portion 30*g* to a flange 35*h***.

Within the member 35 there is a central shaft member 39 of square cross-section aligned with axis 9 and preferably solid as shown, having dimensions matching those of square surface **35*d* so that member 35 can drive shaft member 39 in rotation. Shaft member 39 is provided with an enlarged piston or head 40, having a cylindrical perriphery. Seals 41 and 42 set in recesses of piston 40 and the lower part 35d of wall 35 respectively, permit longitudinal sliding of shaft member 39 relative to shaft member 35. Between shaft member 39 and wall 35*b* there is a space 44 extending from member 35*d* to piston 40. Although no attachment is shown at the lower end of shaft member 39**, it will be understood that for use as an earth drill rig a suitable auger member will be attached there in a well-known manner.

The members 25, 30, 35 and 39 are extendible and retractible by action of hydraulic fluid as will be explained hereinafter. For this purpose there is provided an arrangement of passageways and ports through which the fluid may flow. Fluid passageways are associated with the above described members 10, 30, 35 and 39, the columnar passageways **30*e* and 35*c*** being part of these passageways.

A port 48 is provided through cylindrical wall 10 through which hydraulic fluid may flow into or out of space 49 beneath the cover 11 of the outer tubular member 10, and a port 50 is provided through piston 25 from its outer periphery at a position above seal 51, and a longitudinal passageway 52 through the piston 25 which communicates between space 49 and region 53 between the upper surface of end member 31 and piston 25. The annular space **30*f* between walls 30*a* and 30*d* extends from space 53 to meet a port 55 leading into a space 56 above end member 36. Another passageway 57 leads from space 56 to a port 58 through the outer wall of shaft member 35 and to a port 59 leading through wall 35*b* to a space 60 between end member 36 and the head of piston 40. Beneath a web 61 separating space 30*e* from space 30*f* there is a port 62 providing communication between space 30*e* and a space 63 between the outer cylinder 10 and the shaft member 30. Near the lower end of space 63 there is a port 64 through housing portion 12 also communicating with space 63. Near the lower end of wall 30*d* there is a port 65 providing communication between space 30*e* and space 43, and near the lower end of wall 35*b* there is a port 66 providing communication between space 35*c* and space 44**.

A circular disc-like block 67 is attached to the underside of the top closure or head 11 concentric with the central axis 9. The side wall 68 of block 67 is frusto-conical, its smallest diameter being at its lower horizontal surface 69. From the upper horizontal surface of inwardly extending portion **25*a* of piston 25 there is formed at the outer periphery of this horizontal surface an upstanding annular rim 70 having an inner frusto-conical side wall 71 and an outer frusto-conical side wall 72 so that these side walls 71 and 72 converge towards each other in the upward direction. The conical angles relative to the central axis 9 of side walls 68 and 70 are preferably substantially the same and the vertical dimension that is, the thickness, of disc-like member 67 is preferably substantially the same as the vertical distance or height of the rim 70 above the upper horizontal surface of portion 25*a*. Thus, when the slidable 25 is caused to retract upwardly toward the top closure 11, the side wall 71 moves gradully closer toward side wall 68 near the end of the retraction movement and makes substantial surface contact with it, and at the same time of making this contact, the upper horizontal surface of member 70 is preferably almost, but not quite, in contact with the lower horizontal surface of closure 11, and also the upper horizontal surface of portion 25*a* of the piston 25 preferably comes almost, but not quite, into contact with the under surface 69 of block 67. Furthermore, during such movement of piston 25, the outer wall 72 of rim 70 moves closer to the inner end of port 48 and when the piston 25 is fully retracted to the upper closure 11 the port 50 of the piston becomes aligned with the port 48**.

The underside of portion 31 of shaft member 30 is provided with a concentrically located disc-like block 74 attached similar to the block 67 attached to closure 11, and the likewise the upper surface of closure member 36 of piston 35 is provided with an upstanding rim 75 at its outer periphery similar to the upstanding rim 70 attached to piston head **25*a*, except for being of smaller dimensions. When shaft member 35 is retracted toward closure 31, the frusto-conical inner side of rim 75 meets the frusto-conical side of block 74, in the same manner as described in connection with rim 70 and block 67. Likewise the movement of the frusto-conical outer side of rim 75 moves closer toward port 55 so that ports 58 and 55 become aligned, in the same manner described in connection with frusto-conical side 72 and port 50 in relation to port 48**.

It is further noted that the side 76 at the head of piston 40 is frusto-conical with its smaller diameter end being the upper end. Hence, during a retracting movement of shaft member 39 upward toward closure 36, the spacing of frusto-conical side 76 from port 57 decreases and becomes almost non-existent when the upper hrizontal end of head 40 reaches the underside of closure 36.

The extension and retraction of the piston members is controlled by hydraulic fluid. For this purpose there is shown in phantom lines a simple hydraulic system comprising a fluid reservoir 80 from which there extends a hydraulic conduit 81 connecting with port 48, and another hydraulic conduit 82 connecting with port 64. A fluid pumping means 83 is connected in these lines in such a manner that it can be adjusted to pump fluid in the direction of arrow 83*a* which causes the fluid to enter port 48 to the heads of the pistons to extend the telescoped shaft members, during which operation fluid remaining within the boom arrangement below the pistons is forced out through port 64 through conduit 82 in the direction of arrow 84 to the reservoir. To retract the shaft members the pump arrangement will be readjusted to reverse the fluid flow so that the fluid will flow from the reservoir through conduit 82 in the direction of arrow 85 and will return through conduit 81 in the direction of arrow 86.

Assume now that the boom arrangement is completely retracted so that the pistons 25 and 36*a* and 40 are each in their uppermost positions relative to the next outer shaft member. When the pump is adjusted to pump the fluid through conduit 81 in the direction of arrow 83*a*, the fluid enters port 48 and flows through port 50 which will then be aligned with port 48 and flow in paths indicated by arrows 87. At the same time the fluid already in the system beneath the pistons flows out of the system in the path opposite that indicated by arrows 88 to return to the reservoir in the direction of arrow 84. It will be recognized that this pressurized flow from the pump will force each piston downward relative to top closure 11 and also relative to the upper piston closures of the next larger piston. In the illustraton of FIG. 1, each piston has already undergone some degree of such extending movement or sliding.

When the pump is readjusted to reverse the pumped fluid flow, the pressurized flow will be in the direction of arrows 88 which will apply pressure to the undersides of the pistons to retract all the pistons and their shaft members to their uppermost positions again. During this retraction operation the fluid in the regions above the pistons will flow in the direction opposite that indicated by arrows 87 and flow out of port 48 and back to the reservoir in the direction of arrow 86.

In the absence of the raised annular rims 72 and 74 with their frusto-conical sides approaching the frusto-conical sides of blocks 67 and 74 or the ports of the next outer shaft members, the piston head 25*a* would be driven hard against the upper closure 11 creating an undesirably great shock. Similarly, the piston head 36 would be stopped with great shock against closure 31. Also, if the side wall of piston 40 of stem 39 were cylindrical all the way to the top, it might be stopped with shock against closure 36. By reason of the particular structure according to this invention, however, such shocks are avoided. Thus, when piston 25 is moving upward so that the annular rim 70 is approaching the top closure 11 the outer frusto-conical surface 72 moves closely and finally very close to port 48, tending to restrict outward flow of fluid to the port. Similarly, the frusto-conical surfaces 71 and 68 are approaching each other with diminishing clearance between them which gradually restricts, and finally stops, the flow from region 49 which is ordinarily occuring between the rim 70 and closure 11 to the port 48. These frusto-conical surfaces act as metering surfaces which slow down the approach of piston 25 to closure 11 at the end of the retraction. The same metering action and slowing down of the approach occurs in the case of piston 30 as its piston head approaches closure 31. Likewise the metering surface 76 of piston 40 slows down the retraction of shaft member 39 near the end of its retraction stroke. The slow down of the retraction in each case is not sudden but rather gentle and gradual, by reason of the frusto-conical surfaces which create a gradual restriction rather than a sudden restriction, so that the motion does not become very slow until almost at the end of the retraction stroke in the case of each piston.

Figure 5:
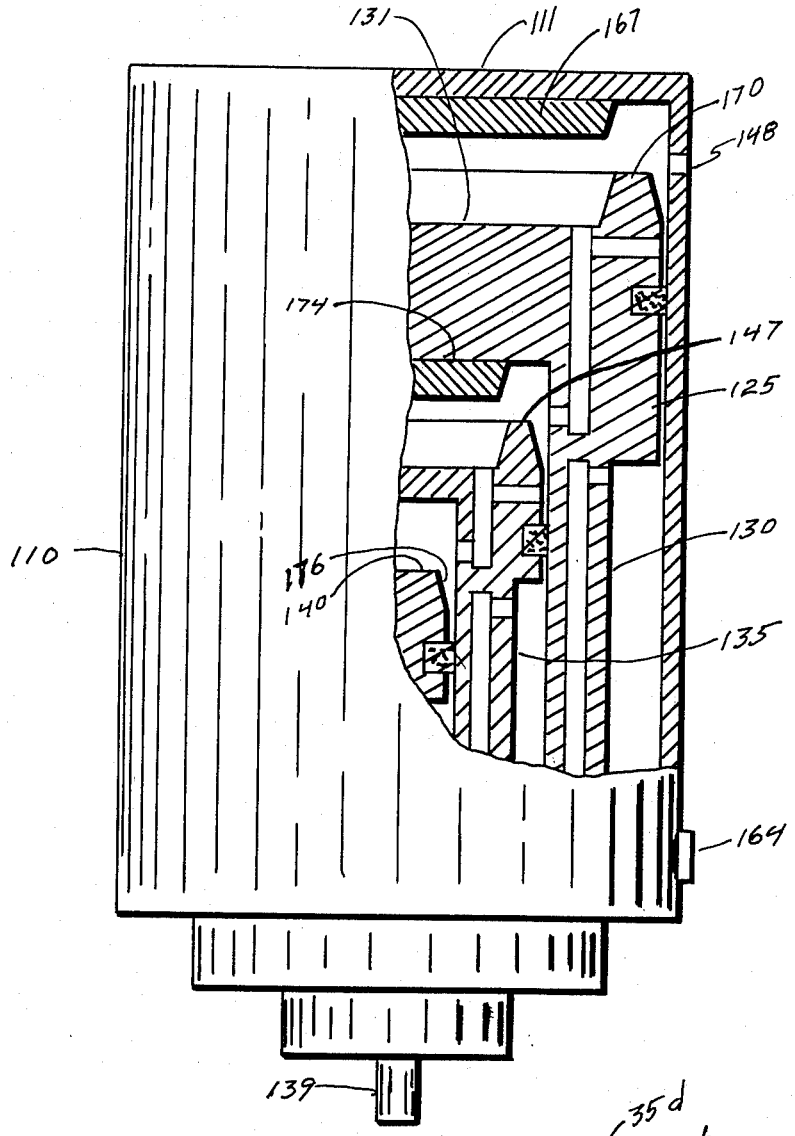
FIG. 5 is an elevation view, partly in cross-section, showing a device somewhat similar to FIG. 1, but not having provision for rotational drive.

FIG. 5 shows an extendible and retractible multistage boom arrangement comprising a number of pistons similar to those shown in FIG. 1, but without any means for providing a rotational drive. It has a cylindrical casing 110 corresponding to casing 10 of FIG. 1 and an upper closure 111 corresponding to closure 11, and it has ports 148 and 164 corresponding to ports 48 and 64 of FIG. 1. Since it is not to be driven in rotation there is not shown any motor drive or gears or gearhousing, and likewise there are no rotational bearings such as bearings 20, 21 and 27 of FIG. 1. Piston 125 corresponds to piston 25 of FIG. 1 and shaft member 130 corresponds with shaft member 30 of FIG. 1, however, since there is no provision for rotational drive, there is no rotational bearing between members 125 and 130, and member 130 is accordingly made integral or attached to piston 125. Piston 135 corresponds to piston 35 and shaft member 139 corresponds with shaft member 39. Piston 125 is slidable longitudinally relative to shaft member 110; shaft member 135 is slidable longitudinally relative to shaft member 130; and shaft member 139 is slidable longitudinally relative to shaft member 135.

Since there is no rotational drive, no provision is made for driving them and accordingly both the inner and outer walls of shaft member 130 are cylindrical and both the inner and outer walls of shaft member 135 are cylindrical and the shaft member 139 is cylindrical. The top closure 111 is provided at its underside with a block 167 like block 67 of FIG. 1 and piston 125 is provided with an annular circumferential upstanding rim 170 like rim 70 of FIG. 1. The block 167 and rim 170 are provided with frusto-conical sides as in the case of blocks 67 and 70 of FIG. 1. The underside of the closure 131 is provided with a block 174 like block 74 of FIG. 1 and the piston member 135 is provided with an upstanding circumferential rim 175 like block 75 of FIG. 1. Block 174 and rim 175 are provided with frusto-conical sides as in the case of the corresponding elements of FIG. 1 and for the same purpose. Piston 140 corresponds with piston 40 of FIG. 1 and has a frusto-conical side 176 correspondig to side 76 of FIG. 1 and for the same purpose. The ports and longitudinal spaces in FIG. 5 are similar to those in FIG. 1 with such difference of geometrical shape as results from the fact that there are no walls of square cross-section in FIG. 5.

Since the paths of fluid flow in the device of FIG. 5 are similar to the corresponding paths in FIG. 1, the extension and retraction operations of the boom are similar in FIG. 5 to those in FIG. 1, and the device of FIG. 5 contains the same shock absorption features. Although the structure in FIG. 1 is shown in a position to extend the boom downwardly it will be understood that it may be extended upwardly or in any direction as may be desired in its use as a boom.

From the drawings and foregoing description it is seen that devices provided with shock absorption according to this invention may be made for rotation as illustrated in FIGS. 1 through 4, or without rotation as illustrated in FIG. 5, although the principle use presently contemplated for it is for rotation as in earth drilling equipment.

Although three extendible shaft members telescoped within the outer cylindrical shell have been illustrated in both FIGS. 1 and 5, it will be understood that more or less telescoped shaft members may be employed, and any one or more of these may be provided with the shock absorbing metering elements. It is noted that two types of metering means are used in these embodiments, one being the metering provided by the oblique side surfaces of blocks 67 and 74 and the corresponding inner oblique side surfces of rims 70 and 75, and the other type being that provided by the outer oblique surfaces such as surface 72 in association with the port passageways which they pass. Although the inclusion of both types of metering in the device will usually be preferred, it should be understood that both types need not necessarily be used. When only one type of metering is used, it will usually be preferable to use metering such as that between block 67 and rim 70.

It should be further noted that although there is a slowdown of retraction as a rim 70 is approaching its related block such as 69, this slowdown does not affect the speed of retraction of other shaft members such as shaft member 35 whose rim 75 may still be a substantial distance away from its corresponding block 74, even while rim 70 is in close proximity to its block 67. Hence, the retraction of each shaft member continues at a relatively rapid rate until it is near the end of its travel period even though another shaft member may be slowing down due to its metering. Hence, the metering at each piston operates independently of the metering at any other piston.

Although the metering surfaces have been shown as frustoconical surfaces, it will be understood that their shape may depart somewhat from the conical shape, and a surface which is oblique to the central axis 9 will perform the metering even though it is not conical. The term oblique as used herein can cover surfaces which have some curvature.

It should be further noted that although square cross-sections of parts of shaft members have been used in the embodiment of FIGS. 1 through 4 for the purpose of transmitting torque from the motor, some other configurations may be used instead, such as for examples, some other non-circular shape such as a hexagon or octagon or keys or splines.

It will be understood that the embodiments of the invention illustrated and described herein are given by way of illustration and not of limitation, and that modifications or equivalents or alternatives within the scope of the invention may suggest themselves to those skilled in the art.

I claim:

1. In an extendible and contractible shaft having a plurality of shaft members having a common longitudinal axis, each shaft member having a head at an end thereof, and each, except the outermost shaft member, being telescoped within the one next adjacent, the head of each telescoped shaft member comprising a piston slidably seated to the inner wall of the next adjacent outer shaft member to form a series of tandem arranged sealed pistons having respective cross-section areas which progessively increase from the innermost piston sealed to the outermost shaft member, each of said piston having a first side and a second side, a first fluid pressure surface defined on said first side of each pistons, a second fluid pressure surface defined on said second side of each of said pistons, said second fluid pressure surface extending circumferentially outwardly from each of said shaft members towards the next adjacent shaft member, a third fluid pressure surface defined on said second side of each of said pistons except the innermost piston, said third fluid pressure surface extending circumferentially inwardly from each of said shaft members except the innermost towards the longitudinal axis.

a fluid passageway through each piston, except the innermost piston in the tandem of said pistons so that said first fluid pressure surfaces of said first sides of all the pistons are in fluid communication with each other, fluid passageways between adjacent shaft members, first fluid communication means providing fluid communication between adjacent fluid passageways at positions at the second sides of the respective pistons, so that said second fluid pressure surfaces of all the pistons are in fluid communication with each other, second fluid communication means providing fluid communication between said first fluid pressure surfaces and said third fluid pressure surfaces of each of said pistons except the innermost and a first inlet port means communicating with said first fluid pressure surface of one of said pistons and a second inlet port means communicating with said second fluid pressure surface said one of said pistons, whereby application of fluid pressure at said first inlet port means introduces pressurized fluid to said first sides of the pistons, which extends the length of said shaft, and application of fluid pressure at said second inlet port means introduces pressurized fluid to said second sides of said pistons, which contracts the length of said shaft, the improvement comprising:

means providing a metering channel in the path of fluid flow between the first side of said one of said pistons and said first inlet port means, thereby permitting metered release of fluid toward said first inlet port means near the end period of the contraction movement of said one piston, and causing blockage of fluid flow at the metering means at the end of said period, and means comprising a channel through said one piston providing fluid communication between the second fluid communication means and the first inlet port means thereby by-passing said blockage.

whereby the contraction movement of said one piston is slowed, thereby alleviating shock, and then stopped, whereupon fluid continues to be released to said first inlet port means, so that said period of slowing is accomplished without affecting the rate of movementof another piston during said perid.

2. The improvement according to claim 1 in which said means providing a metering channel comprises an annular surface oblique to said axis at said first side of the said one piston and a corresponding oblique surface at the juxtaposed head of the next adjacent outer shaft member so that said oblique surfaces move closer to each other near the end period of said contraction movement.

3. The improvement according to claim 2 in which said oblique surfaces are frusto-conical with the axis of said oblique surfaces coinciding with said longitudinal axis.

4. The improvement according to claim 1 in which said means providing a metering channel comprises an annular surface oblique to said axis at said first side of said one piston positioned to move relative to one of said fluid communication means.

5. The improvement according to claim 4 in which said oblique surface is frusto-conical with the axis of said oblique surface coinciding with said longitudinal axis.

6. The improvement according to claim 1 in which said means providing a metering channel comprises an annular surface oblique to said axis at said first side of said one piston and a corresponding oblique surface at the juxtaposed end of the next adjacent outer shaft member so that said oblique surfaces move closer to each other near the end period of said contraction movement, and another annular surface oblique to said axis at said first side of said one piston, positioned to move relative to one of said fluid communication means and closer to said fluid communication means near the end of said period of said contraction movement.

7. The improvement according to claim 1 in which said means providing a metering channel in a path of fluid flow between the first side of at least one of said pistons and said first inlet port means comprises means between the first sides of a plurality of said pistons and said first port means causing metered release of fluid toward said first port means near the end period s of the contraction movements of respective ones of said plurality of pistons.

8. The improvement according to claim 1 in which the means providing a metering channel in a path of fluid flow between the first side of at least one of said pistons and said first port means comprises an annular surface oblique to said axis at the first sides of a plurality of said pistons, each oblique surface being positioned to move relative to a respective one of said fluid communication means near the end period of said contraction movement.

* * * * *